US006084189A

United States Patent [19]

Menche et al.

[11] Patent Number: 6,084,189

[45] Date of Patent: Jul. 4, 2000

[54] ELECTRICAL SWITCH

[75] Inventors: Edgar Menche, Lundenscheid; Jorg Werda, Plettenberg; Silke Gelhausen, Altena, all of Germany

[73] Assignee: Leopold Kostal GmbH & Co. KG, Ludenscheid, Germany

[21] Appl. No.: 09/345,536

[22] Filed: Jun. 30, 1999

[30] Foreign Application Priority Data

Sep. 28, 1998 [DE] Germany ..... 198 44 335

[51] Int. Cl.[7] ..... H01H 25/04

[52] U.S. Cl. ..... 200/315; 200/6 A

[58] Field of Search ..... 200/4, 5 R, 6 R, 200/6 A, 17 R, 18, 310, 313, 315

[56] References Cited

U.S. PATENT DOCUMENTS

| | | | |
|---|---|---|---|
| 4,458,124 | 7/1984 | Kroth et al. | 200/311 |
| 4,975,547 | 12/1990 | Nakayama et al. | 200/5 R |
| 5,047,596 | 9/1991 | Ebishi | 200/4 |
| 5,619,021 | 4/1997 | Yamamoto et al. | 200/6 A |
| 5,619,195 | 4/1997 | Allen et al. | 341/20 |
| 5,744,765 | 4/1998 | Yamamoto | 200/6 A |

FOREIGN PATENT DOCUMENTS

| | | | |
|---|---|---|---|
| 44 10 201 | 9/1995 | Germany | H01H 25/04 |

*Primary Examiner*—Michael Friedhofer
*Attorney, Agent, or Firm*—Brooks & Kushman P.C.

[57] ABSTRACT

An electrical switch includes a housing, fixed contact elements fixed with respect to the housing, and movable contact elements movable with respect to the housing. Each of the movable contact elements is positioned directly opposite from a respective fixed contact element. An auxiliary frame is positioned within the housing and has four bearing eyes offset by 90° with respect to each other. Two first pivot pins are offset by 180° with respect to each other and form a first pivot axis. The two first pivot pins are rotatably received by a respective one of a first bearing eye pair of the auxiliary frame. Two second pivot pins are offset by 180° with respect to each other and form a second pivot axis. The two second pivot pins are rotatably received by a respective one of a second bearing eye pair of the auxiliary frame. An actuating member is operable with the first pivot pins and the second pivots pins for moving about the first pivot axis and the second pivot axis from a neutral position to four actuating positions. In each actuating position the actuating member actuates a respective movable contact element causing the respective movable contact element to contact a respective fixed contact element for enabling a corresponding switching function.

10 Claims, 2 Drawing Sheets

ELECTRICAL SWITCH

TECHNICAL FIELD

The present invention relates generally to electrical switches and, more particularly, to an electrical switch having an actuating member operable with an auxiliary frame positioned within a housing to be movable between different actuating positions from a neutral position.

BACKGROUND ART

Electrical switches switch on and off circuits and switch between circuits. Electrical switches have varied contact systems. An electrical switch is actuated by pivoting its actuating member to adjust the position of a rear-view mirror, a seat part, etc., in motor vehicles. Starting from its neutral position, the actuating member is moved to at least four defined functional or actuating positions. The functions can be performed in a latching and/or pushing manner.

DE 44 10 201 A1 discloses a four-way electrical switch. In the case of this electrical quadrant or four-way switch, the required actuating mechanism includes a central bearing block, a first rocker for the first pivot axis, a second rocker for the second pivot axis, and an actuating member. The two rockers are rotatable held on the bearing block with pivot pins and receive the actuating member with bearing journals. The bearing journals are each held in a bearing eye provided on the corresponding functional partner and is open on one side. The two rockers together with the bearing block form a standard universal joint for the actuating member. The actuating mechanism has a considerable number of components. The components are produced as individual parts and subsequently are assembled in an appropriate manner according to their respective functions.

DISCLOSURE OF INVENTION

Accordingly, it is an object of the present invention to provide an electrical switch of the type described above having fewer individual parts conveniently producible and requiring minimum assembly outlay.

In carrying out the above object and other objects, the present invention provides an electrical switch including a housing, four fixed contact elements fixed with respect to the housing, and four movable contact elements movable with respect to the housing. Each of the movable contact elements is positioned directly opposite from a respective fixed contact element. An auxiliary frame is positioned within the housing and has four bearing eyes offset by 90° with respect to each other. Two first pivot pins are offset by 180° with respect to each other and form a first pivot axis. The two first pivot pins are rotatably received by a respective one of a first bearing eye pair of the auxiliary frame. Two second pivot pins are offset by 180° with respect to each other and form a second pivot axis. The two second pivot pins are rotatably received by a respective one of a second bearing eye pair of the auxiliary frame. An actuating member is operable with the first pivot pins and the second pivots pins for moving about the first pivot axis and the second pivot axis from a neutral position to four actuating positions. In each actuating position, the actuating member actuates a respective movable contact element causing the respective movable contact element to contact a respective fixed contact element for enabling a corresponding switching function.

The advantages of the electrical switch in accordance with the present invention are numerous. It is particularly advantageous that the actuating mechanism can be produced with the housing in a two/three component injection molding tool as a complete subassembly using one operational procedure and one single tool. The subassembly is functional in a preassembled state. Furthermore, it is particularly advantageous that the process of directly injecting the pivot pins into the closed bearing eyes produces a substantially play-free bearing arrangement for the entire actuating mechanism.

The above object and other objects, features, and advantages of the present invention are readily apparent from the following detailed description of the best mode for carrying out the present invention when taken in connection with the accompanying drawings.

BEST MODE FOR CARRYING OUT THE INVENTION

Figure 1:
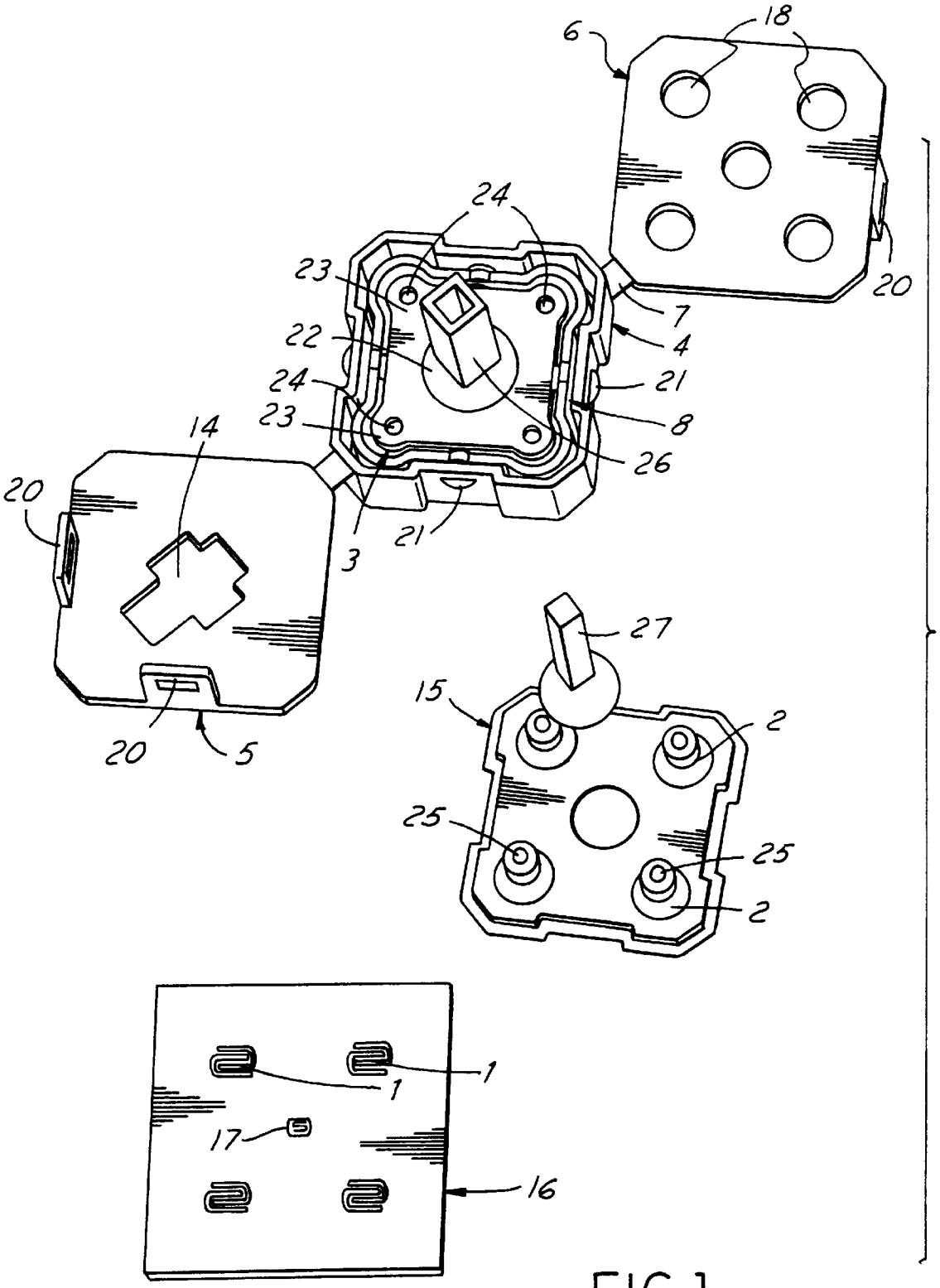
FIG. 1 shows an exploded view of a first exemplified embodiment of the electrical switch in accordance with the present invention.
Figure 2:
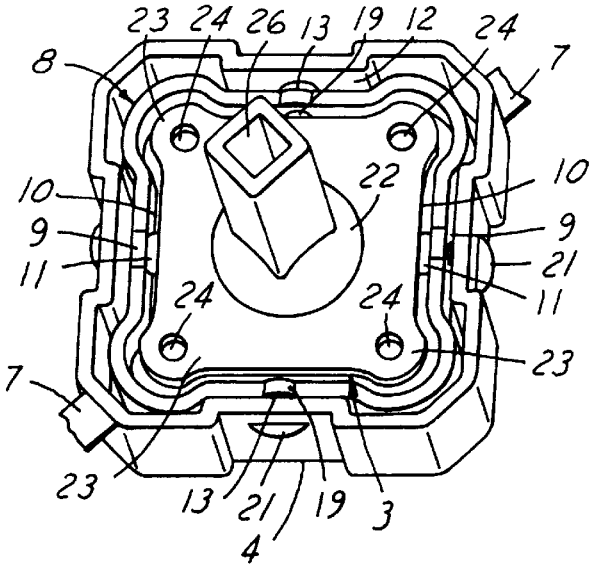
FIG. 2 shows an enlarged plan view of the electrical switch shown in FIG. 1 without a housing cover and a housing pedestal.

Referring now to FIGS. 1–2, an electrical switch in accordance with a first embodiment of the present invention is shown. The electrical switch includes a housing. The housing receives fixed contact elements 1 and movable contact elements 2. At least one movable actuating member 3 is movable from a neutral position in a cross-wise path using a universal joint to at least four defined functional or actuating positions. In each of the actuating positions, actuating member 3 causes a respective movable contact element 2 to contact a respective fixed contact element for enabling a corresponding switching function.

The housing is a one piece unit made up of a housing base 4, a housing cover 5, and a housing pedestal 6. Housing cover 5 and housing pedestal 6 are each connected as one piece to housing base 4 by an integrally formed, flexible cross-piece 7. Actuating member 3 is surrounded by a substantially square auxiliary frame 8. Auxiliary frame 8 contains four closed bearing eyes 9, 19. Closed bearing eyes 9, 19 are disposed offset by 90° with respect to each other.

A pair of first pivot pins 11 are integrally formed on two respective opposite-lying outer regions 10 of actuating member 3. First pivot pins 11 form a first pivot axis and are each received in a rotatable manner by a respective one of a first bearing eye pair 9 of auxiliary frame 8. A pair of second pivot pins 13 are integrally formed on an inner wall 12 of housing base 4. Second pivot pins 13 form a second pivot axis disposed 180° offset with respect to the first pivot axis. Second pivot pins 13 are each received in a rotatable manner by a respective one of a second bearing eye pair 19 of auxiliary frame 8.

The housing is produced as one piece and includes an actuating mechanism. The actuating mechanism has a standard universal joint so that actuating member 3 can be shifted in all directions from a neutral position. To obtain a defined setting for the displacement of actuating member 3, housing cover 5 is provided with a cross-shaped shifting gate 14.

As illustrated in particular in FIG. 1, fixed contact elements 1 are disposed on a printed circuit board 16. Printed circuit board 16 includes an electrical component 17 such as a light emitting diode to illuminate the electrical switch. Fixed contact elements 1 are disposed on the main surface of printed circuit board 16 facing actuating member 3.

To obtain a fully functional switch, it is initially necessary to insert a dome switching mat 15 into housing base 4. Then, starting from their respective original positions which are predetermined by the production process, housing cover 5 and housing pedestal 6 are folded using two integrally formed, flexible cross-pieces 7 to their final assembled position. Housing cover 5 and housing pedestal 6 include attachment tabs 20 integrally formed as one piece. Attachment tabs 20 latch to attachment projections of housing base 4 for attaching housing cover 5 and housing pedestal 6 to housing base 4.

Consequently, dome switching mat 15 is fixed in position precisely between the lower side of housing base 4 and the inner main surface of housing pedestal 6. Subsequently, printed circuit board 16 is fixedly attached on housing pedestal 6 to housing base 4. The main surface of printed circuit board 16 operable with actuating member 3 lies closely against the outer main surface of housing pedestal 6.

Four holes 18 are provided in housing pedestal 6. Four movable contact elements 2, which are formed as dome switch contacts of dome switching mat 15, are each operable with a respective one of the four contact elements 1 lying opposite and fixed on printed circuit board 16. For each direction of actuation of actuating member 3, a fixed contact element 1 and a movable contact element 2 are combined to form one functional group. Printed circuit board 16 thus forms the pedestal-side termination of the electrical switch and for this reason also includes the contact points required for an electrical connection. The contact points are each designed as edge contacts, i.e., provided for direct connection to a plug-in contact part. The plug-in contact part is designed in a corresponding manner and is connected to the associated network structure via electrical lines.

Printed circuit board 16 can also be formed such that a plurality of electrical switches can be produced in any arrangement using a single printed circuit board 16. If a fully-housed electrical switch is required, then, similar to dome switching mat 15, printed circuit board 16 is inserted in advance into housing base 4. Housing pedestal 6 is then subsequently fixed on housing base 4 in an exact position. Housing pedestal 6 thus forms the pedestal-side termination of the electrical switch. In this case, printed circuit board 16 can also be formed as a flexible conductor foil.

Actuating member 3 includes a central region 22 formed in the shape of a spherical portion. Integrally formed on the central region 22 are four actuating regions 23 which, remote from central region 22, move directly into position with movable contact elements 2 of dome switching mat 15. The four actuating regions 23 are integral components of an actuating plate. The actuating plate surrounds central region 22 in one piece. The actuating plate is integrally formed on central region 22 as a square. The actuating plate has each of its four free corner regions operable with a respective movable contact element 2. To deflect the actuating plate diagonally, first and the second pivot pins 11, 13 and bearing eyes 9, 19 are each disposed offset by 45° with respect to the displacement directions of actuating member 3. The displacement directions are predetermined by cross-shaped shifting gate 14.

Actuating regions 23 are located as far as possible from central region 22 and lie on actuating member 3. To be operable with individual movable contact elements 2, the four actuating regions 23 each include a cut-out 24. Cut-outs 24 engage a respective associated projection 25 provided in one piece on the four movable contact elements 2. To perform the deflection appropriate for functional purposes, the dome switching contacts are chamfered on their head surface extending in the direction of central region 22. Thus, movable contact elements 2 can be displaced relatively precisely at 90° with respect to the main surface of printed circuit board 16.

A journal 26 is integrally formed on central region 22 of actuating member 3. In relation to the main surfaces of printed circuit boards 16, journal 26 includes an arrangement protruding perpendicularly from central region 22. To shift between the functions of the electrical switch, journal 26 is actuated directly or else by a handle piece connected thereto. To attach a handle piece such as a seat part, a round knob, etc., holding means, e.g., in the form of latch projections are integrally formed on journal 26.

Journal 26 is a hollow rectangular tube for receiving a rod-shaped light guiding element 27. Alternatively, for providing light-guiding regions the hollow chamber of actuating member 3 can be filled with a transparent synthetic material.

Journal 26 is integrally formed on one side to central region 22 and operable on the other side with cross-shaped shifting gate 14 of housing cover 5. Shifting gate 14 guides actuating member 3 in a defined manner so that upon actuation the actuating member can be moved cross-wise. Actuating member 3 moves cross-wise starting from its middle neutral position to only into the four defined functional positions or actuating positions of the electrical switch. Malfunctions or any overloads in the electrical switch are thus reliably obviated.

For the actuating member 3 to be mounted, it moves with its spherical portion-shaped central region 22 into position on correspondingly formed bearing sites of housing cover 5. In so doing, movable contact elements 2 become pretensioned by the dimensions of central region 22 and corresponding bearing sites and of the arrangement of printed circuit board 16 and the dome switching mat 15 are tailored to suit each other. This is therefore a simple way of guaranteeing an exact, defined neutral position of actuating member 3. Furthermore, housing cover 5 protects the electrical switch from dirt and covers the shape of the switch effectively.

Accordingly, it is apparent that in accordance with the present invention an actuating mechanism which can be loaded continuously is produced in a convenient manner. Actuating member 3, the housing, and auxiliary frame 8 are combined to form one functional subassembly producible in a single tool.

Figure 3:
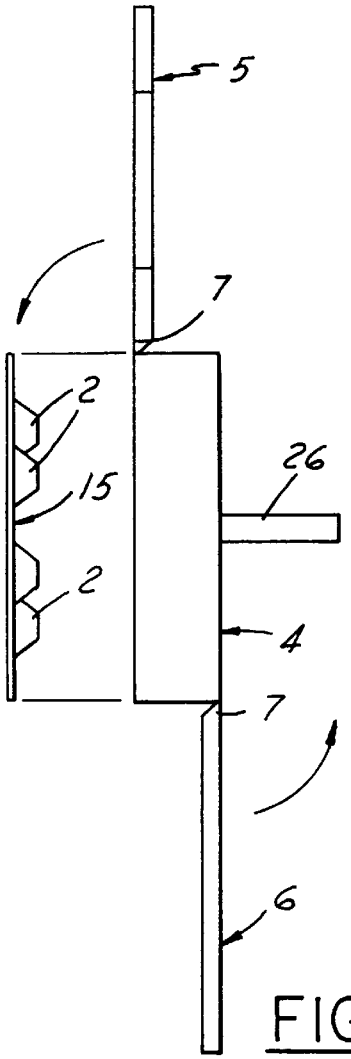
FIG. 3 shows a front view of a second exemplified embodiment of the electrical switch in accordance with the present invention and an associated dome switching mat.
Figure 4:
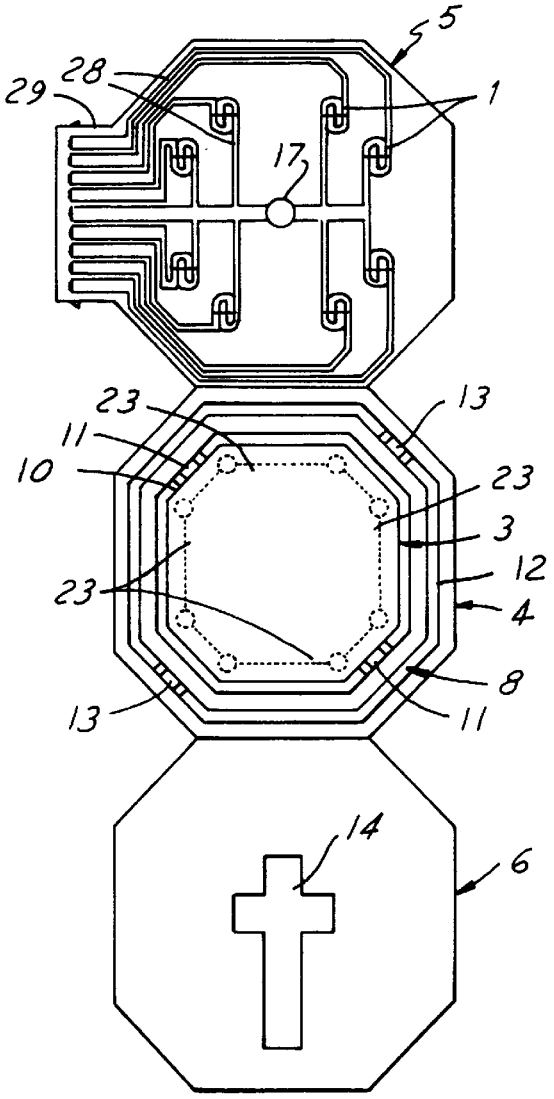
FIG. 4 shows a plan view of the electrical switch shown in FIG. 3 without the associated dome switching mat.

FIGS. 3–4 show a second exemplified embodiment of an electrical switch. The electrical switch shown in FIGS. 3–4 generally corresponds to the electrical switch shown in FIGS. 1–2 in accordance with the first exemplified embodiment. Only the differences between the embodiments will be described.

As is particularly evident in FIGS. 3–4, the housing, the actuating plate of actuating member 3, and auxiliary frame 8 are substantially octagonal. Housing pedestal 5 of the housing is designed as a MID-part to reduce the number of individual parts from three parts as in the first embodiment to two parts. MID means that fixed contact elements 1 and the required conductor track structure 28 are attached directly to the main surface of housing pedestal 5. Fixed contact elements 1 are metal electric lines facing actuating member 3. A separate printed circuit board is therefore no longer required.

To achieve a fully functional electrical switch, dome switching mat 15 must initially be inserted into housing base 4. Then, starting from their respective starting positions as predetermined by the production process, housing cover 5 and housing pedestal 6 are folded to their final assembled position by two integrally formed, flexible cross-pieces 7. To attach housing cover 5 and housing pedestal 6 securely, latch means provided on housing base 4, housing cover 5, and housing pedestal 6 are connected together. By this procedure, dome switching mat 15 is fixedly held in an exact position between the lower side of housing base 4 and the inner main surface of housing pedestal 6. At the same time, fixed contact elements 1 provided as metallization on housing pedestal 5 are each operable with a respective movable contact element 2 of dome switching mat 15.

The end regions of conductor track structure 28 run on to a common connection region 29. Connection region 29 represents a substantially rectangular extension of housing pedestal 5 so that a plug-in coupling can be connected at a central site to the electrical switch. The free ends of conductor track structure 28 are formed as contact points. The contact points connect directly to the associated network structure by plug-in contact elements of the plug-in coupling and connected electrical lines. Connection region 29 includes latch projections 30 integrally formed as a single piece. The associated plug-in coupling is pushed directly on to connection region 29 and is securely fixed thereon by correspondingly formed latch tabs.

Fixed contact elements 1 and movable contact elements 2 are designed with redundancy so that in total there are eight fixed and eight movable contact elements 1, 2. This guarantees increased electrical functional reliability for the electrical switch as well as simultaneously providing increased actuating forces for actuating member 3. Shifting gate 14 provided in housing cover 6 is designed similarly as in the electrical switch in accordance with the first exemplified embodiment so that starting from its neutral position actuating member 3 can be pivoted into four defined functional positions. For each actuation direction of actuating member 3, two fixed contact elements 1 and two movable contact elements 2 are combined to form one functional group to guarantee redundancy. To deflect the actuating plate diagonally, the first and second pivot pins 11, 13 and bearing eyes 9, 19 are each disposed offset by 45° with respect to the displacement directions of actuating member 3 as predetermined by cross-shaped shifting gate 14.

In the case of a non-redundant design of the movable and fixed contact elements 1, 2 it is possible to achieve an increase in function in this type of electrical switch while reducing the number of individual parts. In the case of a shifting gate 14 modified accordingly and provided in housing cover 6, actuating member 3 can be pivoted, e.g., in a star-shaped manner, in a total of eight defined functional or actuating positions.

Thus it is apparent that there has been provided, in accordance with the present invention, an electrical switch that fully satisfies the objects, aims, and advantages set forth above. While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An electrical switch comprising:

a housing having a housing base, a housing cover, a housing pedestal, a first flexible attachment, and a second flexible attachment, wherein the first flexible attachment is integrally formed between the housing base and the housing cover for connecting the housing cover to the housing base, and the second flexible attachment is integrally formed between the housing base and the housing pedestal for connecting the housing pedestal to the housing base, wherein the housing cover and the housing pedestal fold about the respective flexible attachments and latch to the housing base to form a one piece housing;

four fixed contact elements fixed with respect to the housing;

four movable contact elements movable with respect to the housing, each of the movable contact elements positioned directly opposite from a respective fixed contact element;

an auxiliary frame positioned within the housing and having four bearing eyes offset by 90° with respect to each other;

an actuating member positioned within the auxiliary frame;

two first pivot pins integrally formed on the actuating member, the two first pivot pins offset by 180° with respect to each other and forming a first pivot axis, the two first pivot pins rotatably received by a respective one of a first bearing eye pair of the auxiliary frame; and two second pivot pins integrally formed on the housing base, the two second pivot pins offset by 180° with respect to each other and forming a second pivot axis, the two second pivot pins rotatably received by a respective one of a second bearing eye pair of the auxiliary frame;

wherein the actuating member is operable with the first pivot pins and the second pivots pins for moving about the first pivot axis and the second pivot axis from a neutral position to four actuating positions, wherein in each actuating position the actuating member actuates a respective movable contact element causing the respective movable contact element to contact a respective fixed contact element for enabling a corresponding switching function.

2. The electrical switch of claim 1 wherein:

the actuating member includes a spherical shaped central region.

3. The electrical switch of claim 2 wherein:

the actuating member includes four actuating regions connected to the central region and disposed remote from the central region, wherein the actuating regions contact respective movable contact elements when the actuator member moves to the respective actuating positions.

4. The electrical switch of claim 3 wherein:

the four actuating regions are integral components of an actuating plate which surrounds the central region in one piece.

5. The electrical switch of claim 3 wherein:

each of the four actuating regions are formed as actuating arms, wherein the four actuating arms protrude in respective orthogonal directions from the central region.

6. The electrical switch of claim 1 wherein:

each of the movable contact elements are formed as a dome switching contact of a dome switching mat.

7. The electrical switch of claim 1 further comprising:

a printed circuit board fixed to the housing, wherein the fixed contact elements are provided on the printed circuit board.

8. The electrical switch of claim 1 wherein:

the fixed contact elements are metal electric lines disposed on the housing.

9. The electrical switch of claim 2 further comprising:

a journal integrally formed on the actuating member and protruding therefrom.

10. The electrical switch of claim 1 wherein:

the first pair of pivot pins and the second pair of pivot pins are each disposed offset by 45° with respect to the four actuating positions of the actuating member.

* * * * *